United States Patent [19]

Lee et al.

[11] Patent Number: 4,569,417

[45] Date of Patent: Feb. 11, 1986

[54] BUCKLED BELT FOR THE EMERGENCY ESCAPE

[76] Inventors: Woo K. Lee, 580-2, Shinsa-Dong, Kangnam-Ku, Seoul; Young H. Kim, 415, Sungsan-Dong, Mapo-Ku, Seoul, both of Rep. of Korea

[21] Appl. No.: 666,919

[22] Filed: Oct. 31, 1984

[30] Foreign Application Priority Data

Jan. 10, 1984 [KR] Rep. of Korea ..... 1984-167[U]

[51] Int. Cl.[4] ..... A62B 1/16

[52] U.S. Cl. ..... 182/5; 2/338

[58] Field of Search ..... 182/3, 5, 6, 7; 2/338 R

[56] References Cited

U.S. PATENT DOCUMENTS

| | | | |
|---|---|---|---|
| 311,039 | 1/1885 | Scheid et al. | 182/5 |
| 547,450 | 10/1895 | Quinn | 182/5 |
| 1,574,529 | 2/1926 | Abraham | 182/6 |
| 1,858,256 | 5/1932 | Wolfe | 182/5 |
| 3,419,236 | 12/1968 | Weber | 182/5 |
| 3,498,408 | 3/1970 | Foote | 182/6 |
| 3,834,489 | 9/1974 | Rabelos | 182/5 |
| 4,102,431 | 7/1978 | Carroll | 182/5 |

*Primary Examiner*—Reinaldo P. Machado

*Attorney, Agent, or Firm*—Birch, Stewart, Kolasch & Birch

[57] ABSTRACT

A steel wire is extended from one end of a belt to a ring of a buckle through a small escape device inserted a pair of control plates, pulling speed of said wire being controlled by a rack gear with roller and a pair of control plates constituted with a fixed control plate and a moving control plate, wherein said moving control plate is controlled by control bolts positioned on the side surface of a small escape device, and said small escape device is disassembled from said buckle in an emergency.

1 Claim, 5 Drawing Figures

BUCKLED BELT FOR THE EMERGENCY ESCAPE

BACKGROUND OF THE INVENTION

Field of the Invention

The present invention relates in general to a buckled belt and in particular to a buckled belt for emergency escape, employed to escape rapidly from high building when quite an unforeseen danger from a fire lies ahead.

So far, there were problems that since persons stayed at hotel in high building could not easily find an emergency exit when a fire occured, they wander from place to place and eventually, it could be produced a great loss of life.

Tourists often carry with an emergency escape device for the protection of lives. However, it was trouble-some to carry with it every time they travel.

Thus, the present invention relates to a buckled belt capable of being used as an escape device and a conventional belt.

SUMMARY OF THE INVENTION

The present invention relates to a buckled belt for emergency escape using for escape from a danger caused by a fire occured in high building. More particularly, the buckled belt of the the present invention relates to the belt of a form such as a conventional belt, and comprise a belt inserted a folded steel wire, a small escape device controlling pulling speed of said steel wire and a buckle connected with said steel wire passed through from one end of said belt to said small escape device, wherein said belt includes a folded steel wire which one end thereof is fastened in an end of said belt and another end thereof is connected with said small escape device, said small escape device consisting of a roller and a rack gear mounted coaxially with a fixed pin wherein they control pulling speed of said steel wire and a fixed control plate and a moving control plate adjusting said steel wire with guide rods, rectangular holes, helix rods, lugs, grooves, a control bolt and a small hole, said buckle including a ring fastening another end of said steel wire and connection holes connecting resilience rods.

It is an object of the present invention to use as a belt such as a conventional belt and to employ it as a device for emergency escape when danger such as a fire occurs.

Other objects and advantages of the present invention will become apparent to those skilled in the art from the following detailed description of the preferred embodiment when read in light of the accompanying drawings.

DETAILED DESCRIPTION OF A PREFERRED EMBODIMENT

Figure 1:
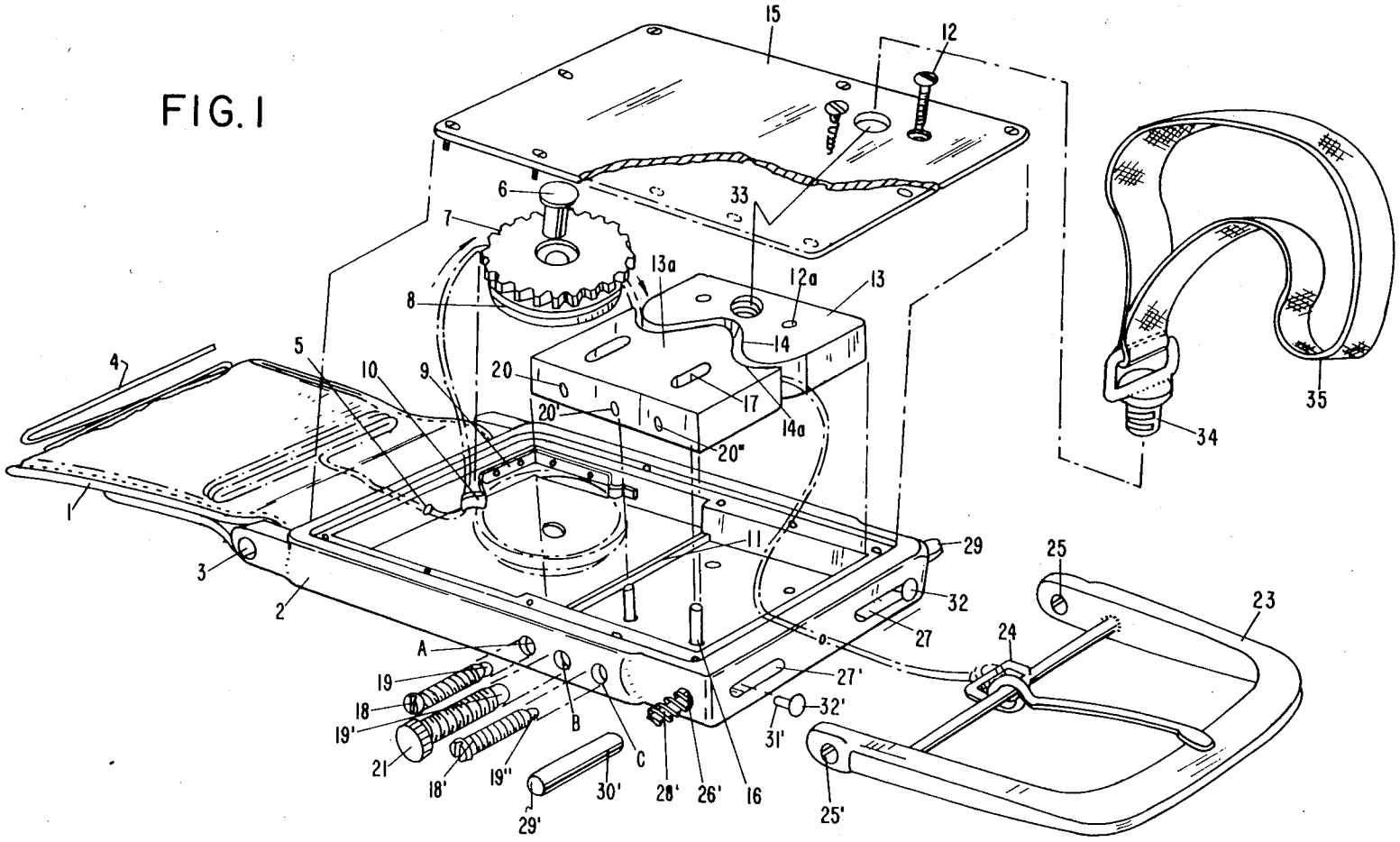
FIG. 1 is a perspective view disassembled the essential parts of the present invention.
Figure 2:
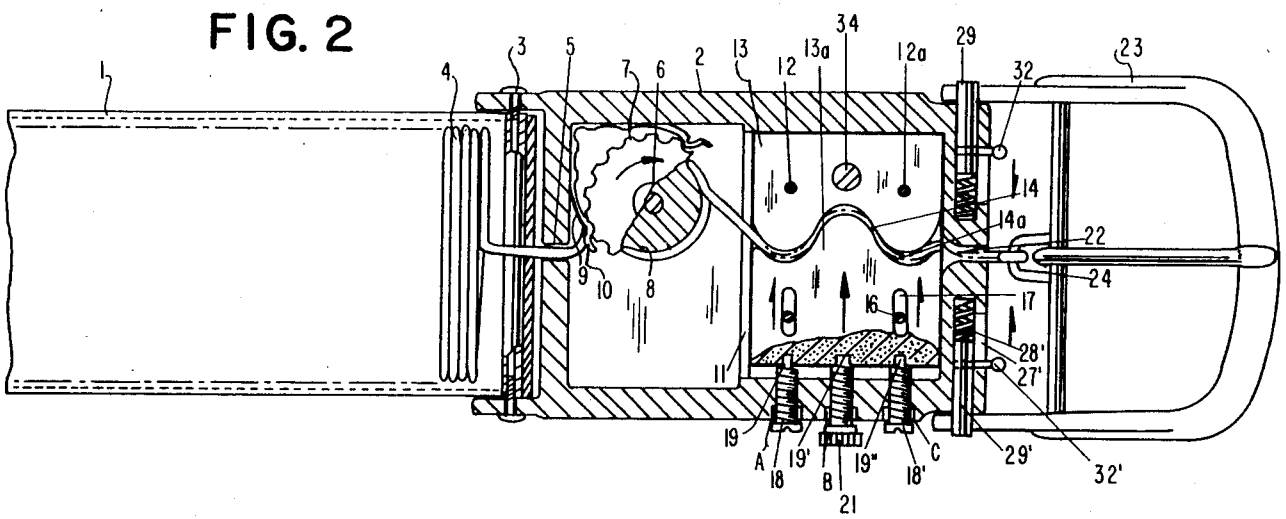
FIG. 2 is a plane sectional view illustrated the operation status of the present invention.
Figure 3:
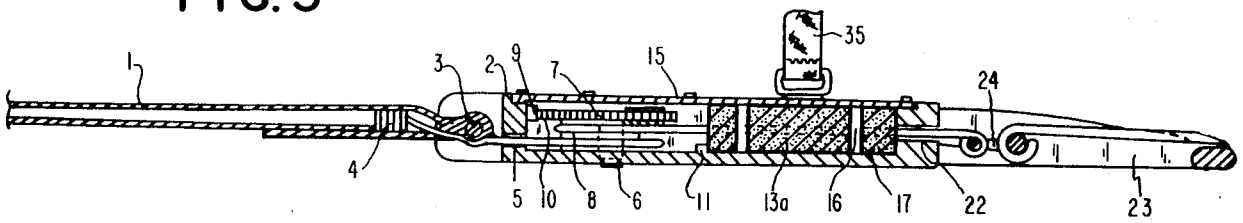
FIG. 3 is a side sectional view of a buckled belt of the present invention.
Figure 4:
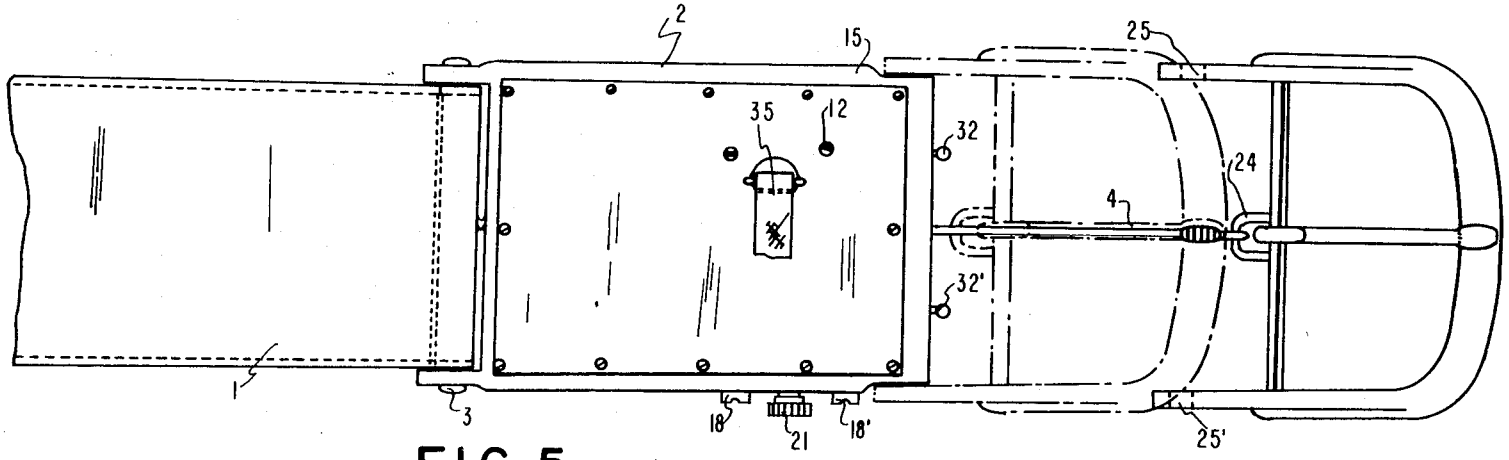
FIG. 4 is a plane view disassembled the buckled belt of the present invention.
Figure 5:
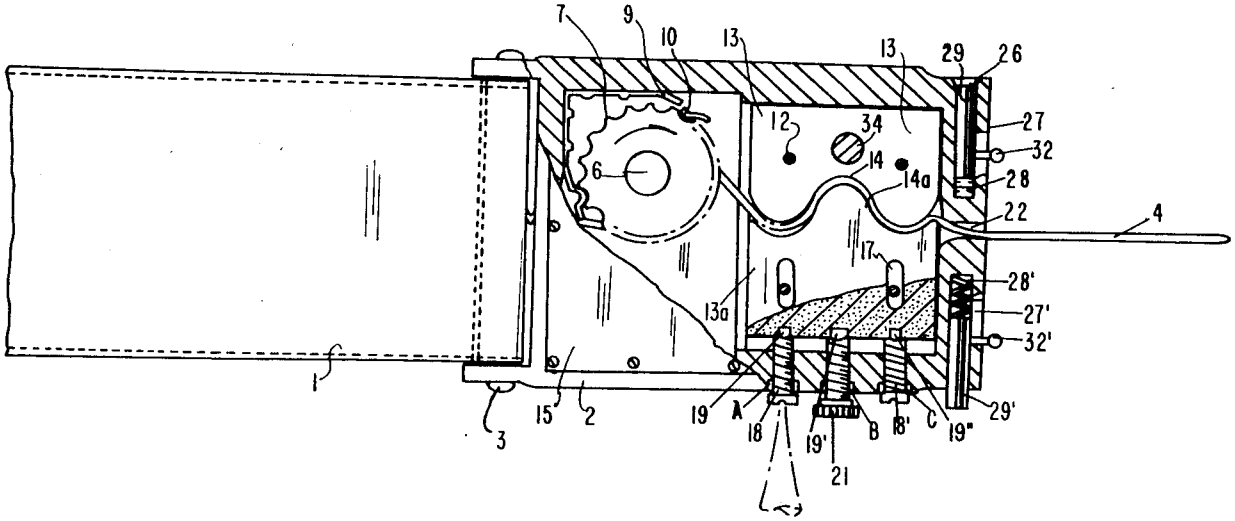
FIG. 5 is a plane sectional of the status tightened internal control plate of the emergency escape device of the present invention.

Referring now to the drawings, a front end of a belt (1) is wound to a fixed axis (3) of a small escape device (2), in the inner space of the belt (1), one end of steel wire (4) inserted therein by bending to be folded as coil spring is fixed by knotting in a hole bored at another end of the belt (1), and another end of the steel wire (4) is passed closely over a fixed axis (3), passed through a connection hole (5) in the rear of the small escape device (2) and wound along a guide groove (not shown number) of roller (8), said roller (8) being constructed coaxially with rack gear (7) by supporting of a fixed pin (6) and thus rotating radially centering around the fixed pin (6), said rack gear engaging closely with both bending faces (10) of plate spring (9) fixed on internal corner of a small escape device (2) and thus controlling rotation of rack gear (7).

A fixed control plate (13) and a moving control plate **(13*a*) are positioned to the upper direction of a guide projection (11), wherein the fixed control plate (13) is fixed coaxially with a cover (15) and the small escape device (2) by screw-coupling of helical holes (12*a*) bored in both side thereof and bolts (12), and inner sections of the fixed control plate (13) and the moving control plate (13*a*) are formed with bending parts (14) (14*a*), respectively, to be cooperated each other, said moving control plate (13*a*) is mounted on a guide rod (16) lugged in both side of internal part of the small escape device (2), passing through a rectangular hole (17) bored vertically in both side of moving control plate (13*a*) and thus, said moving control plate (13*a*) can be removed longitudinally along the rectangular hole (17). Helix rods (18) (18') are screw-coupled with (A) (C) of spiral holes (A) (B) (C) bored at lower part of the small escape device (2) and lugs (19) (19') of extremity of helix rods (18) (18') are put into grooves (20) (20'') of grooves (20) (20') (20'') formed on outer surface of the moving control plate (13*a*). Accordingly, the bending part (14*a*) of the moving control plate (13*a*) is engaged with the bending part (14) of the fixed control plate (13)** at regular gap.

A control bolt (21) is screwed up with a spiral hole (B) to be inserted a lug (19') of the control bolt (21) into a groove (20') of the moving control plate **(13*a*) and by operation of said control bolt (21), said moving control plate (13*a*) is removed longitudinally along the rectangular hole (17) connected with the guide projection (11) and the guide rod (16), in which, the steel wire (4) passed between the bending part (14) of the fixed control plate (13) and the bending part (14*a*) of the moving control plate (13*a*) are connected with a ring (24) of a buckle (23) via a small hole (22) bored in the body of the small escape device (2)**.

In both side of the buckle (23), connection holes (25) (25') are formed and in the upper and lower edges of the small escape device (2), holes (26) (26') are formed, and resilience rods (29) (29') supported resiliently with springs (28) (28') and bored spiral holes (30) (30') are insert into said holes (26) (26') of the small escape device (2), said spiral holes (30) (30') screwing up with bolts (31) (31') having lugged knobs (32) (32') passing through said rectangular grooves (27) (27').

Both connection holes (25) (25') of the buckle (23) and resilience rods (29) (29') then are connected by adjusting with knobs (32) (32') compressing and expanding with springs (28) (28').

Further, a bolt (34) having a band (35) is screwed in a spiral groove (33) passed through from cover (15) of the small escape device to the fixed control plate (13).

The belt of the present invention can be wore commonly or in traveling, is secured in the human body because width of the belt is broad and upon a man using this belt, lengths of the steel wire (4) inserted in the belt are different from, respectively, but in general, since the steel wire (4) of about 40–50 m is inserted in the belt, even if a certain dangerous due to a fire lies ahead, persons can be escaped readily and rapidly.

When a fire breaks out suddenly in a place stayed at hotel, the buckle (23) is disassembled, pressing resilience rods (29) (29′) connected in both connection hole (25) (25′) of buckle (23), into holes (26) (26′), by the inner spring (28) (28′), compressing inwardly knobs (32) (32′) in the rectangular grooves (27) (27′) of the small escape device. And then the buckle (23) is fastened at steadily fixed substance or is hung on an appropriate ring to be fastened securely. And then, in accordance with body weight of a user, the steel wire (4) is controlled, not to be easily loosen between the bending part (14) of the fixed control plate (13) and the bending part (14*a*) of the moving control part (13*a*), said helix rods (18) (18′) are screwed up, considering body weight of the user and the user then is jumped down from a window or a balcony of a dangerous place, taking the band (35) and the belt (1), fastening or loosening the moving control plate (13*a*) with the control bolt (21) in accordance with the falling speed, wherein the steel wire (4) bended to be folded into the belt (1) is unfastened in order. Accordingly, speed of revolution of the roller (8) is getting more fast gradually, according to the falling speed by body weight, in which since the bending face (10) of the plate spring (9) contacted with both side of rack gear (7) at the upper part of roller (8) is controlled upon rate of revolution of rack gear (7), the steel wire (4) wound one time on the roller (8) is unfastened while it is rubbed between a close gap of the bending part (14) of the fixed control plate (13) and the bending part (14*a*) of the moving control plate (13*a*) and is jumped down at the rate of 1.5–2 m per a second.

As the above-mentioned, the buckled belt of the present invention is characterized that it can be worn usually and also when a certain dangerous due to a fire lies ahead, persons can be escaped readily and rapidly using it.

What is claimed is:

1. A buckled belt for the emergency escape comprising: one front end of a belt (1) is connected with a fixed axis (3) in the rear of a small escape device (2), one end of the steel wire (4) get folded as a coil spring into said belt (1) is knotted firmly in a hole bored at another end of the belt (1), further another side of said steel wire (4) is passed closely with said fixed axis (3), passed through a connection hole (5) in the rear of the small escape device (2) and wound one time along a roller (8) mounted on a fixed pin (6), said steel wire (4) controlling with both bending faces (10) of a plate spring (9) contacted closely with a surface of a rack gear (7) being constituted coaxially with the roller (8), further said steel wire (4) connecting with a ring (24) of a buckle (23), passing through a small hole (22) bored on the body of the small escape device (2) via between the bending part (14) of the fixed control plate (13) and the bending part (14*a*) of the moving control plate (13*a*), and said fixed control plate (13) joining together with a cover (15), screwing up a bolt (12) into a helical hole (12*a*) passing through them to settle with the surface of the small escape device (2), and a bolt (34) with a band (35) is screwed with a spiral groove (33) passing the cover (15) and the fixed control plate (13), said moving control plate (13*a*) removing longitudinally along a rectangular hole (17) bored vertically on both side thereof, which is mounted on a guide rod (16) lugged on both side of internal surface of the small escape device (2), helix rods (18) (18′) is screwed with spiral holes (A) (C) of lower surface of the small escape device (2) to be inserted lugs (19) (19′) of extremity of the helix rods (18) (18′) into grooves (20) (20″) of the moving control plate (13*a*), a control bolt (21) is screwed with the spiral hole (B) to be inserted the lug (19′) of the control bolt (21) into the groove (20′) of the moving control plate (13*a*), resilience rods (29) (29′) supporting with springs (28) (28′) and boring spiral holes (30) (30′) is inserted into holes (26) (26′) bored on the upper and the lower of the small escape device (2), and then bolts (31) (31′) with lugged knobs (32) (32′) passing through the rectangular grooves (27) (27′) is screwed with the spiral holes (30) (30′), said resilience rods (29) (29′) operating with said knobs (32) (32′) to connect them with both connection holes (25) (25′) of the buckles (23).

* * * * *